United States Patent [19]

Piesinger

[11] 4,079,379

[45] Mar. 14, 1978

[54] NULL STEERING APPARATUS FOR A MULTIPLE ANTENNA ARRAY

[75] Inventor: Gregory H. Piesinger, Scottsdale, Ariz.

[73] Assignee: Motorola, Inc., Schaumburg, Ill.

[21] Appl. No.: 744,008

[22] Filed: Nov. 22, 1976

[51] Int. Cl.[2] ..... H01Q 3/26

[52] U.S. Cl. ..... 343/100 SA; 343/100 CL; 343/100 LE; 343/854

[58] Field of Search ..... 343/100 SA, 100 LE, 343/100 CL, 854

[56] References Cited

U.S. PATENT DOCUMENTS

| | | | |
|---|---|---|---|
| 3,670,335 | 6/1972 | Hirsch | 343/100 SA |
| 3,763,490 | 10/1973 | Hadley et al. | 343/100 LE X |
| 4,032,922 | 6/1977 | Provencher | 343/100 SA X |

*Primary Examiner*—Maynard R. Wilbur

*Assistant Examiner*—Richard E. Berger

*Attorney, Agent, or Firm*—Eugene A. Parsons

[57] ABSTRACT

Null steering apparatus in a multiple antenna array including means associated with each antenna for separating signals therefrom into in-phase and quadrature components which can be adjusted so that unwanted signals from the array are cancelled and further including circuitry for separating an identifier signal from the desired signal and utilizing the identifier signal to produce a replica of the desired signal which is subtracted from the feedback loop of the null steering apparatus to form a lobe in the antenna pattern in the direction of the desired signal. In this circuit the desired signal is a PSK digital data signal and the identifier is a similar signal transmitted at a lower level and leading by one bit. The circuitry in the null steering apparatus delays the identifier by one bit so that it is a replica signal of the desired signal.

13 Claims, 3 Drawing Figures

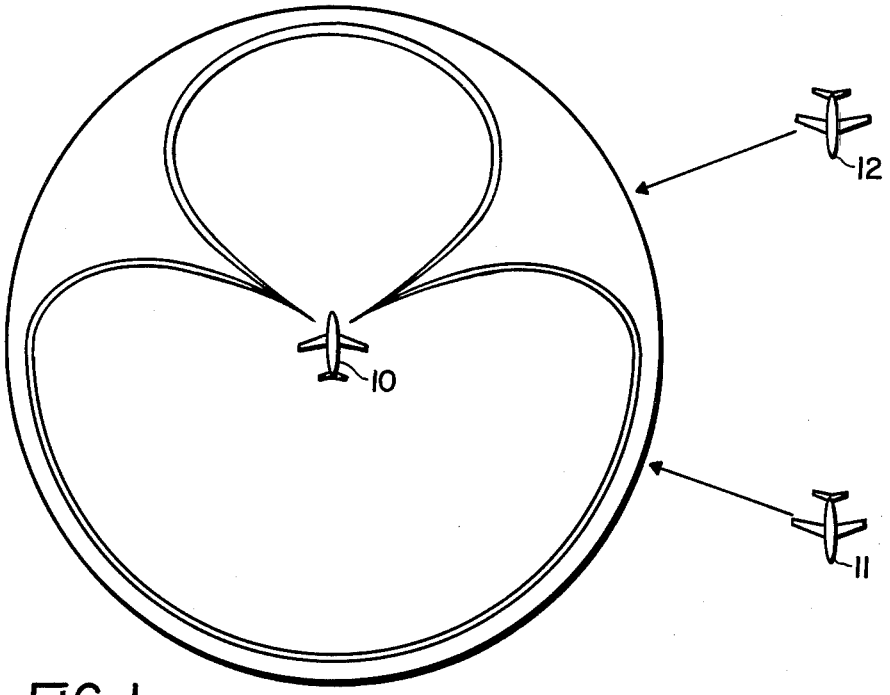
FIG. 1
FIG. 3
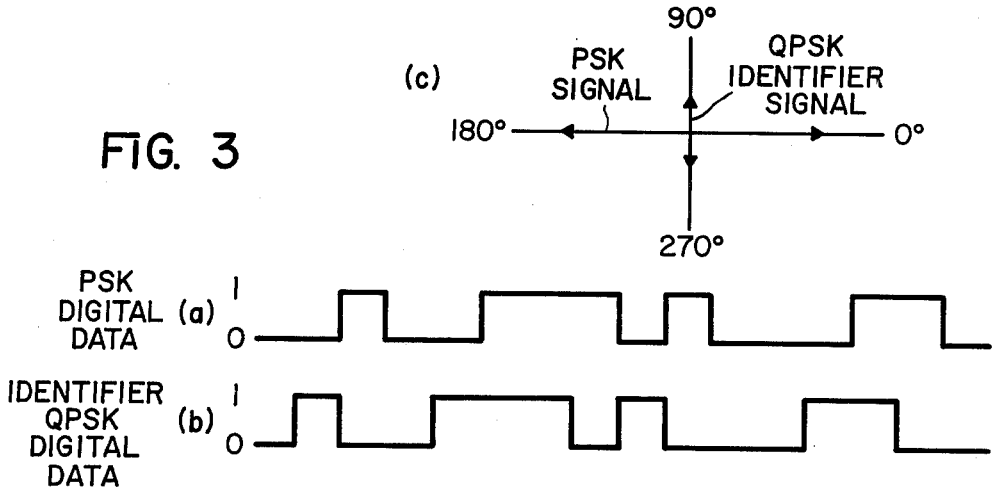

NULL STEERING APPARATUS FOR A MULTIPLE ANTENNA ARRAY

BACKGROUND OF THE INVENTION

Null steering or adaptive noise cancelling is a procedure which has been known for many years and is described, for example, in such typical articles as "Adaptive Antenna Systems", by B. Widrow et al, Proceedings of the IEEE, Vol. 55, No. 12, December 1967, and "Adaptive Noise Cancelling: Principles and Applications", by B. Widrow et al, Proceedings of the IEEE, Vol. 63, No. 12, December 1975. In general, null steering is a technique whereby two or more antenna signals are weighted and summed together to form a composite antenna pattern. The pattern is formed in such a manner as to create antenna pattern nulls in the direction of the jamming signals and lobes in the direction of desired signals. Using null steering techniques, nulls on the order of 50dB can be automatically steered in the direction of a jamming signal.

Using, for example, a four channel null steerer, each antenna signal is split into an in-phase component and a quadrature component with a 90° hybrid circuit or the like. The two signal components are then weighted and summed together along with the signal components from the other antenna weighters, in a final summing circuit. By using a 90° hybrid circuit and weighters, a single phasor (any specific signal on an antenna can be represented by a phasor) on a particular antenna can be shifted to any new phase and amplitude desired. If a jamming signal, or any other undesired signal, is present on two antennas, for example, the null steerer will shift the two signals (phasors) such that they are equal amplitude and opposite phase. When these two weighted signals are then summed together in the final summing circuit, they will cancel, thereby forming an antenna pattern null in the direction of the jamming signal. The process is similar when the jamming signal is present on all four antennas. The number of independent nulls that can be formed is equal to N-1 where N is the number of antennas.

The values of the weighters are automatically adjusted by feeding back the output of the final summing circuit to a correlator or mixer, which mixes the output with each of the signal components from the antenna, which is nonweighted, thereby creating a correlation voltage. This correlation voltage is integrated and used to drive the specific weighter for that antenna component. The weighters are always driven in such a manner as to minimize the feedback signal. When the feedback signal is completely eliminated, corresponding to forming a complete null, the output of the correlator is zero and the system has fully adapted. A null steerer implemented in this manner will null out all signals as long as the number of signals is equal to or less than N-1.

To prevent nulling of desired signals, a reference signal must be used. Any prior art null steering systems which utilize a reference, simply insert an estimate of the desired signal. This reference, or estimated signal, is then used to subtract off the desired signal present at the output of the final summing circuit, thereby, preventing it from being fed back to the correlators. If the estimated signal differs from the desired signal in phase or content, a null will also be formed in the direction of the desired signal and the desired signal will be lost. Thus, it is essential that the reference signal be extremely accurate.

SUMMARY OF THE INVENTION

The present invention pertains to null steering apparatus in a multiple antenna array wherein a desired signal and an identifier signal are transmitted simultaneously, with the identifier signal being separated from the desired signal and utilized to produce a replica of the desired signal having at least one characteristic similar to a characteristic of the desired signal, and the replica signal is utilized to form a lobe in the antenna pattern in the direction of the desired signal in the array.

It is a further feature of the present invention to provide null steering apparatus, in a multiple antenna array, for PSK carrier reception wherein PSK digital data is transmitted accompanied by a lower power level QPSK signal, i.e., PSK data advanced by one bit, said null steering apparatus including feedback means associated with each antenna in said array for separating signals from the antenna, representable as a phasor, into in-phase and quadrature components and adjusting the in-phase and quadrature components to alter the amplitude and phase of the phasor so that unwanted signals from the array are cancelled, QPSK demodulator means coupled to said feedback means for receiving the QPSK signal from the array and providing a digital output delayed by one bit, a voltage controlled oscillator operating at the frequency of the PSK carrier, which may be the transmitted RF or the RF converted to an IF, and connected in a phase locked loop with said QPSK demodulator for providing an output signal that is substantially a replica of the PSK digital data, and subtractor means for utilizing the replica signal to subtract the PSK carrier from the signals in said feedback means to form a lobe in the antenna pattern in the direction of the PSK signal.

It is an object of the present invention to provide new and improved null steering apparatus in a multiple antenna array.

It is a further object of the present invention to provide new and improved null steering apparatus in a multiple antenna array including a new and improved apparatus and method for providing a reference signal to form a lobe in the antenna pattern in the direction of a desired signal.

It is a further object of the present invention to provide new and improved null steering apparatus for PSK carrier reception wherein PSK digital data is transmitted accompanied by a lower power level identifier signal, which identifier signal is utilized to produce a replica of the PSK digital data and the replica signal is utilized to form a lobe in the antenna array pattern in the direction of the PSK signal.

These and other objects of this invention will become apparent to those skilled in the art upon consideration of the accompanying specification, claims and drawings.

BRIEF DESCRIPTION OF THE DRAWINGS

Referring to the drawings,

FIG. 1 illustrates a typical antenna pattern for a multiple antenna array incorporating null steering apparatus;

FIG. 3 illustrates typical transmitted waveforms for reception by null steering apparatus such as that disclosed in FIG. 2.

DESCRIPTION OF THE PREFERRED EMBODIMENT

Figure 2:
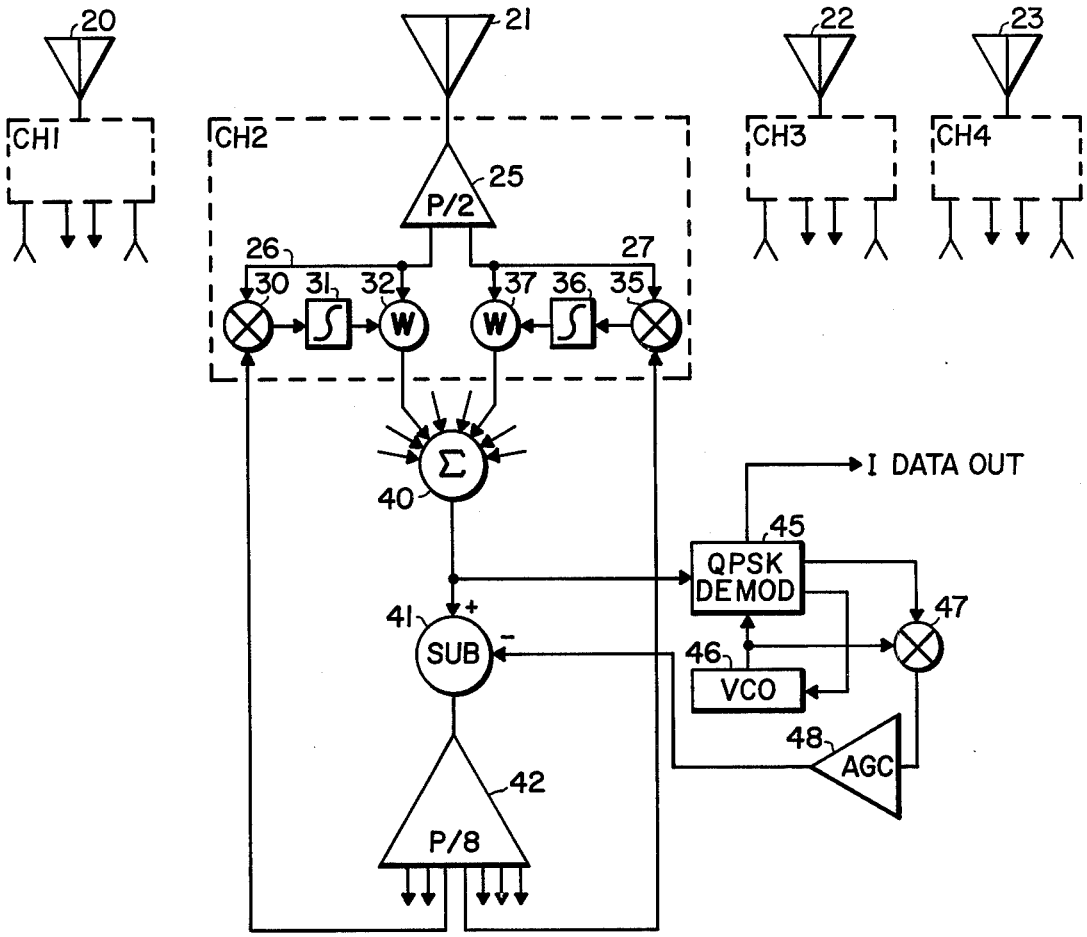
FIG. 2 is a block diagram of a multiple antenna array incorporating null steering apparatus embodying the present invention.

Referring specifically to FIG. 1, an airplane 10 is illustrated carrying a multiple antenna array with null steering apparatus and communications equipment connected thereto. In this specific example, the communications equipment connected to the multiple antenna array is tuned to communicate with a transmitter on a second airplane, designated 11. Jamming signals, for the purpose of frustrating communications between the airplanes 10 and 11, may be transmitted from some source, such as a transmitter on a third airplane 12. The purpose of the multiple antenna array with null steering apparatus is to provide an antenna pattern, typically as shown in FIG. 1, wherein an antenna lobe is directed toward the desired signal from the airplane 11 and an antenna null is directed toward the jamming signal from the airplane 12. In this fashion the jamming signal can be substantially eliminated and the desired signal can be received with very little or no interference. The multiple antenna array with null steering apparatus, located aboard the airplane 10, which provides the antenna pattern illustrated in FIG. 1, is illustrated by the block diagram of FIG. 2. For use in cooperation with the apparatus illustrated in FIG. 2, the transmitter on the airplane 11 is constructed to transmit an identifier signal at the same time that it transmits the desired signal. This identifier signal will be described in more detail in conjunction with FIGS. 2 and 3.

Referring specifically to FIG. 2, a multiple antenna array is illustrated, consisting of four antennas designated 20–23. Any specific signal on any one of the antennas 20–23 can be represented by a phasor and each antenna has associated therewith electronics, designated channel 1 through channel 4, for manipulating the signal so that the phasor has substantially any desired amplitude and phase. Each of the channels 1 through 4 are identical and, therefore, only channel 2 will be described in detail and it should be understood that each of the remaining channels operates in a similar fashion and contains similar apparatus.

A 90° hybrid, or phase splitter, 25 is connected to receive the signals from antenna 21 and supply in-phase and quadrature components thereof on lines 26 and 27, respectively. It should be understood that circuitry can be interposed between the antennas and the phase splitters to alter the frequency of the incoming signal, e.g., IF type circuitry. The line 26, transmitting the in-phase component, is connected to one input of a correlator, which may be a mixer or multiplier 30 that provides a signal at an output thereof which is representative of the correlation between the signal applied from the line 26 and a signal applied to a second input of the correlator 30. Output signals from the correlator 30 are integrated in an integrator 31 and applied to a control input of a weighting circuit 32, a second input of which is connected to the line 26. The weighting circuits 32 may be, for example, a variable amplifier or attenuator wherein the signal from the integrator 31 adjusts the amplitude, or weight, of the signal passing through the weighting circuit 32 from the line 26. In a similar fashion, the line 27 is connected to one input of a correlator 35, which correlator 35 has an output connected through an integrator 36 to the control input of a weighting circuit 37. The weighting circuit 37 also has an input connected to the line 27. The correlator 35, integrator 36 and weighting circuit 37 are substantially identical to the correlator 30, integrator 31 and weighting circuit 32, respectively.

The outputs of the weighting circuits 32 and 37, as well as similar outputs from channels 1, 3 and 4, are applied to a summing circuit 40. The summing circuit 40 has a single output which is connected to one input of a subtractor circuit 41 with a single output which is applied through a power splitter 42 to each of the second inputs of the correlators 30, 35, and the two correlators in each of the channels 1, 3 and 4. The output of the summing circuit 40 is connected to one input of a QPSK demodulator 45. A second input of the demodulator 45 is connected to an output of a voltage controlled oscillator 46 which has an input connected to an output of the demodulator 45. The output of the demodulator 45 is also connected to a modulator 47 having a second input connected to the output of the voltage controlled oscillator 46. The voltage controlled oscillator 46 is connected into a phase locked loop, or carrier reconstruction loop, with components in the demodulator 45 and actually forms a portion of the demodulator. The output of the modulator 47 is connected through an AGC amp 48 to a second input of the subtracting circuit 41. The useful information from the system is taken from the I data output of the QPSK demodulator 45.

In the operation of the specific embodiment illustrated, it should first be understood that the transmitter at the airplane 11 transmits a PSK (phase shift keyed) carrier modulated by digital data and simultaneously transmits a lower power level identifying signal which, in this embodiment, is a QPSK signal, i.e., the PSK data advanced by one bit. The PSK digital signal is illustrated in FIG. 3 (*a*) and the QPSK signal is illustrated in FIG. 3 (*b*). The PSK carrier signal is a biphase modulated carrier and the QPSK identifier consists of a biphase modulated signal that is transmitted at a lower power level and in phase quadrature to the primary PSK signal. The quadrature PSK data is identical to the primary PSK data except that it is advanced by one bit. It should, of course, be understood that identifiers having different phase relationships to the original or desired signal may be utilized but the present one is disclosed because of its simplicity of operation and construction.

Signals from the antenna 21 are split into an in-phase component and a quadrature component in the phase splitter 25. The two signal components are then weighted by the weighting circuits 32 and 37 and summed together, along with the signals from the other antenna weighters, in the summing circuit 40. The values of the weighting circuits 32 and 37 are automatically adjusted by feeding back the output of the summing circuit 40 through the subtractor 41 and power splitter 42 to the correlators 30 and 35. The feedback signal is correlated with the nonweighted signal from the phase shifter 25 to create a correlation voltage which is integrated and used to drive the weighting circuits 32 and 37. The weighting circuits 32 and 37 are always driven in such a manner as to minimize the feedback signal. When the feedback signal is completely eliminated, corresponding to forming a complete null, the output of the correlators 30 and 35 is zero and the system has fully adapted. A null steerer implemented in this manner will null out all signals as long as the number of signals is equal to or less than N-1, where N is the number of antennas. A signal present at the antenna can be represented by a phasor and the phase splitter 25 and weighting circuits 32 and 37 are utilized to shift the phasor to any phase and amplitude desired. For example, if a jamming signal is present on antennas 20 and 21, the null steerer will shift the two signals (phasors) such that they are of equal amplitude and opposite phase. When these two weighted signals are then summed together in the summing circuit 40, they will cancel, thereby forming an antenna pattern null in the direction of the jamming signal, as illustrated in FIG. 1. The process is similar when the jamming signal is present on all four antennas.

As is well known by those skilled in the art, QPSK signals can be demodulated either by coherent or differentially coherent phase direction. Coherent detection involves the generation of a phase coherent reference carrier at the demodulator from the received QPSK carrier using a phase-locked loop. Two principle types of carrier reconstruction loops are used for QPSK demodulator: (1) the Costas loop or I-Q, and (2) the frequency quadrupling loop. Either type of demodulation and loop may be utilized in the present apparatus since they have the same output except for minor operating characteristic differences.

The demodulator 45 detects the QPSK signal at the output of the summing circuit 40 and, through a standard integrate and dump detection technique, integrates the signal energy over an entire bit period and uses the resulting integrator output to regenerate a digital "1" or "0". The regenerated digital data is therefore delayed by one bit from the incoming information bit. Since the QPSK data is advanced from the PSK data by one bit, the demodulated data at the output of the demodulator 45 is exactly coincident with the PSK data.

The demodulated data at the output of the demodulator 45 is used to biphase modulate the output of the voltage controlled oscillator 46 in the modulator 47. The VCO signal is a carrier of exactly the same frequency and phase as the PSK carrier. While the terms "PSK carrier" and "transmitted signal" are used in this disclosure it should be understood that the terms are meant to include not only the carrier actually transmitted but any other signals, eg. IF signals, to which the transmitted signal is converted before being applied to the present circuit. The resulting reference signal applied to the AGC amplifier 48 is, therefore, an exact replica of the incoming PSK signal. This replica signal is applied to the subtracting circuit 41 to form a lobe in the antenna pattern in the direction of the PSK signal. By subtracting the replica signal in the substracting circuit 41, the desired signal, i.e., the PSK data, is not fed back to the correlators 30 and 35 and, since the desired signal is not present at the correlators 30 and 35, no null will be formed thereon. The important point to be understood is that the system has fully adapted only when the feedback signal is zero. Therefore, if the power output from the AGC amplifier 48, i.e., the replica signal power output, equals the desired signal output power from the summing circuit 40 the output of the subtracting circuit 41, which is the feedback signal to the correlators, will be equal to zero and a lobe will be formed on the desired signal. Therefore, through the use of the present null steering apparatus a replica signal is produced which is a PSK signal of the same frequency and phase as the desired signal and is utilized to form a lobe in the antenna pattern in the direction of the desired signal. It should be understood, that replica signals might also be produced for different types of modulation and data and, also, different apparatus might be utilized for picking off the identifier signal and for generating a replica signal therefrom.

While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

What is claimed is:

1. In a multiple antenna array, null steering apparatus for reception of a desired signal wherein an identifier signal is transmitted with said desired signal, said null steering apparatus comprising:

a. feedback means associated with each antenna in said array for adjusting the amplitude and phase of signals therein so that unwanted signals from the array are cancelled;

b. replica producing means coupled to said feedback means for picking off the identifier signal and utilizing the identifier signal to generate a replica signal having at least one characteristic similar to a characteristic of the desired signal; and c. compensating means coupled to said feedback means for utilizing the replica signal to form a lobe in the antenna pattern in the direction of reception of the desired signal in the array.

2. In a multiple antenna array, null steering apparatus for reception of a desired signal wherein an identifier signal is transmitted with said desired signal, said null steering apparatus comprising:

a. feedback means associated with each antenna in said array for separating signals coupled from the antenna, representable as a phasor, into in-phase and quadrature components and adjusting the in-phase and quadrature components to alter the amplitude and phase of the phasor so that unwanted signals from the array are cancelled;

b. replica producing means coupled to said feedback means for picking off the identifier signal and utilizing the identifier signal to generate a replica signal having at least one characteristic similar to a characteristic of the desired signal; and c. compensating means coupled to said feedback means for utilizing the replica signal to form a lobe in the antenna pattern in the direction of reception of the desired signal in the array.

3. In a multiple antenna array, null steering apparatus for PSK carrier reception wherein PSK digital data is transmitted accompanied by a lower power level identifier signal, similar to the PSK digital data with a different phase, said null steering apparatus comprising:

a. feedback means associated with each antenna in said array for separating signals from the antenna, representable as a phasor, into in-phase and quadrature components and adjusting the in-phase and quadrature components to alter the amplitude and phase of the phasor so that unwanted signals from the array are cancelled;

b. replica producing means coupled to said feedback means for picking off the identifier signal and adjusting the phase to provide a signal that is substantially a replica of the PSK digital data; and c. compensating means coupled to said feedback means for utilizing the replica signal to form a lobe in the antenna pattern in the direction of reception of the PSK digital data in the array.

4. Null steering apparatus as claimed in claim 3 wherein the replica producing means includes delay means.

5. Null steering apparatus as claimed in claim 4 wherein the delay means includes demodulator means for detecting the identifier signal and integrating over a one bit period.

6. Null steering apparatus as claimed in claim 5 wherein the delay means further includes carrier insertion means for reinserting a carrier into an output signal from the demodulator means, which reinserted carrier is substantially the same frequency and phase as the PSK carrier.

7. Null steering apparatus as claimed in claim 6 wherein the carrier insertion means includes a voltage controlled oscillator operating at approximately the frequency of the PSK carrier having an output connected to an input of the demodulator means and to an input of modulator means, the output signal of the demodulator means being connected to an input of the voltage controlled oscillator and to a second input of the modulator means, and an output of the modulator means being coupled to the compensating means.

8. Null steering apparatus as claimed in claim 7 wherein the compensating means includes subtractor means for removing the replica signal at the output of the modulator means from signals in the feedback means.

9. Null steering apparatus as claimed in claim 3 wherein the feedback means includes summing means for summing the in-phase and quadrature components from each antenna and the compensating means and replica producing means are coupled to an output of said summing means.

10. In a multiple antenna array, null steering apparatus for PSK carrier reception wherein PSK digital data is transmitted accompanied by a lower power level QPSK signal, i.e., PSK data advanced by one bit, said null steering apparatus comprising:

a. feedback means associated with each antenna in said array for separating signals from the antenna representable as a phasor into in-phase and quadrature components and adjusting the in-phase and quadrature components to alter the amplitude and phase of the phasor so that unwanted signals from the array are cancelled;

b. QPSK demodulator means coupled to said feedback means for receiving the QPSK signal from the array and providing a digital output delayed by one bit;

c. a voltage controlled oscillator operating at the frequency of the PSK carrier and connected in a phase locked loop with said QPSK demodulator for providing an output signal that is substantially a replica of the PSK digital data; and d. subtractor means for removing the output signal of the phase locked loop from the signals in said feedback means to form a lobe in the antenna pattern in the direction of reception of the PSK digital data in the array.

11. In a communications system including a transmitter for transmitting a desired signal and a receiver having a multiple antenna array attached thereto a method of null steering the array comprising the steps of:

a. transmitting an identifier signal with the desired signal;

b. separating signals from each antenna, representable as a phasor, into in-phase and quadrature components and adjusting the amplitude of the components to vary the amplitude and phase of the phasor so that unwanted signals from the array are cancelled;

c. separating the identifier signal from the desired signal and utilizing the separated identifier signal to generate a replica signal having at least one characteristic similar to a characteristic of the desired signal; and d. utilizing the replica signal in adjusting the amplitude of the components to form a lobe in the antenna pattern in the direction of reception of the desired signal in the array.

12. In a communications system including a transmitter for transmitting a carrier modulated with a desired signal and a receiver having a multiple antenna array attached thereto a method of null steering the array comprising the steps of:

a. transmitting an identifier signal, similar to the desired signal and differing therefrom in at least one characteristic, with the carrier modulated with the desired signal;

b. adjusting the amplitude and phase of the signals so that unwanted signals from the array are cancelled;

c. separating the identifier signal from the carrier modulated with the desired signal and utilizing the separated identifier signal to generate a replica signal of the carrier modulated with the desired signal; and d. utilizing the replica signal in adjusting the amplitude and phase of the signals to form a lobe in the antenna pattern in the direction of reception of the desired signal in the array.

13. In a communications system including a transmitter for transmitting a carrier modulated with PSK digital data and a receiver having a multiple antenna array attached thereto a method of null steering the array comprising the steps of:

a. transmitting an identifier signal, similar to the PSK digital data having a phase different than the PSK digital data, with the modulated carrier;

b. separating signals from each antenna, representable as a phasor, into in-phase and quadrature components and adjusting the amplitude of the components to vary the amplitude and phase of the phasors so that unwanted signals from the array are cancelled;

c. separating the identifier signal from the carrier modulated with PSK digital data and utilizing the separated identifier signal to generate a replica signal of the carrier modulated with PSK digital data; and d. utilizing the replica signal in adjusting the amplitude of the components to form a lobe in the antenna pattern in the direction of reception of the PSK digital data in the array.

* * * * *